US005215311A

United States Patent [19]

Schuller

[11] Patent Number: 5,215,311

[45] Date of Patent: Jun. 1, 1993

[54] AMUSEMENT DEVICE

[76] Inventor: Michael P. Schuller, 422 Cheshire Ct., Somerset, N.J. 08873

[21] Appl. No.: 831,461

[22] Filed: Feb. 5, 1992

[51] Int. Cl.[5] ..... A63F 9/24

[52] U.S. Cl. ..... 273/460; 273/433; 273/153 R; 273/238

[58] Field of Search ..... 273/433, 460, 459, 237, 273/238, 153 R, 157 R

[56] References Cited

U.S. PATENT DOCUMENTS

| | | | |
|---|---|---|---|
| 3,388,483 | 6/1968 | Weisbecker | 273/153 R |
| 3,488,052 | 1/1970 | Weisbecker | 273/153 R |
| 3,516,671 | 6/1970 | Estrin | 273/238 |
| 3,697,076 | 10/1972 | Vogel | 273/238 |
| 4,021,044 | 5/1977 | Matsumoto | 273/238 |
| 4,339,135 | 7/1982 | Breslow et al. | 273/433 |
| 4,513,973 | 4/1985 | Sinclair | 273/237 |
| 4,809,979 | 3/1989 | Skowronski et al. | 273/433 |
| 4,957,292 | 9/1990 | Miffitt et al. | 273/433 |

FOREIGN PATENT DOCUMENTS

| | | | |
|---|---|---|---|
| 1174049 | 8/1985 | U.S.S.R. | 273/238 |
| 1461487 | 2/1989 | U.S.S.R. | 273/433 |
| 1466770 | 3/1989 | U.S.S.R. | 273/433 |

*Primary Examiner*—Jessica J. Harrison

*Attorney, Agent, or Firm*—Lerner, David, Littenberg, Krumholz & Mentlik

[57] ABSTRACT

An electronic amusement device having preprogrammed game playability uses logical balls or tokens and multi-colored lights to achieve a final state. Game play is based upon the selection of one of three sizes of tokens to be played along one of three different token paths. As game play progresses, the lights change color state while certain tokens are trapped by being made unavailable for further play, while other previously played tokens are released for future play. Control of the state of colors and state of token traps is controlled by a number of erasable programmable read only memories. Game play ends upon achieving a final state designating a specific color array of lights and tokens trapped.

24 Claims, 4 Drawing Sheets

AMUSEMENT DEVICE

BACKGROUND OF THE INVENTION

The present invention relates in general to an amusement device in the nature of a state of mind game, and more particularly, to a multi-functional toy, puzzle and/or learning tool having multi-function playability for all ages to achieve a preprogrammed final state or solution.

Over the years, electronic games of all types have become increasingly popular. These games may be broken down into a number of generalized categories such as computer action/adventure games and computer mind games. The computer action/adventure game is typically a graphic oriented game which enables the manipulation of one or more figures and/or objects, such as sports games and the like. These games generally challenge one's dexterity and reflexes in manipulating a joy stick to control the figure and/or object during game play as different game scenarios are presented. On the other hand, computer mind games more frequently rely upon one's ability to logically solve a posed problem or to remember a given pattern of reappearing sequential events and the like. To date, the number of mind games available has been limited, the market being saturated with a great variety of action/adventure games, such as sports, martial arts, combat, adventure and the like game programs. Accordingly, there is the need for new developments in mind games which challenge the player and which provide the user with many hours of playability.

SUMMARY OF THE INVENTION

In accordance with one object of the present invention, there is disclosed an amusement device in the nature of a computer mind game whose object is to attain a final state or solution consisting of a predetermined color pattern of an array of multi-colored lights and of rendering unavailable for subsequent game play a predetermined number of logical balls or tokens of different size.

Another object of the present invention is to provide an amusement device which may be preprogrammed to define a plurality of selectable final end states or solutions compatible with the age and skill of the player.

Another object of the present invention is to provide an amusement device which may be readily preprogrammed to play any one of a plurality of games at different skill levels through replaceable game cartridges which include the preprogrammed game instructions.

Another object of the present invention is to provide an amusement device whose final end state or solution may be based upon one or more functions which are dependent upon any number of multiple variables which may be interrelated in any desired manner.

In accordance with one embodiment of the present invention, there is disclosed an amusement device including indicators and tokens having a final state, the device comprising a plurality of indicators each having a plurality of different indicator states, the indicator states arrangable into selected a predetermined pattern comprising an indicator end state, indicator control means for controlling the state of the indicators, a plurality of tokens each having a first and second state, the tokens arrangable into selected ones of the first and second states comprising a token end state, and token control means for controlling the state of the tokens between the first and second states, the final state of the device comprising the tokens arranged in the token end state and the indicators arranged in the indicator end state.

In accordance with another embodiment of the present invention, there is disclosed an amusement device including color indicators and tokens having a final state, the device comprising a plurality of color indicators each having a plurality of different color states, the color states arrangable into a predetermined pattern comprising a color end state, color indicator control means for controlling the color of the color indicators among the color states, a plurality of tokens each having a first and second state, the tokens arrangable into selected ones of the first and second states comprising a token end state, and token control means for controlling the state of the tokens between the first and second states, the final state of the device comprising the tokens being in the token end state and the colors of the color indicators being in the color end state.

In accordance with another embodiment of the present invention, there is disclosed an amusement device having a final state, the device comprising a plurality of lights each capable of displaying a plurality of different colors, the color of the lights arrangable into a plurality of color patterns in response to a light function, at least one of the color patterns comprising a color end state, light control means for controlling the color of the lights in response to the light function, a plurality of tokens of at least two different designations playable in a plurality of different paths, the tokens having a first and second state in response to a predetermined token function, the tokens being available for game play when in the first state and unavailable for game play when in the second state, the tokens arrangable into selected ones of the first and second states comprising a token end state, token control means for controlling the state of the tokens in response to the token function, the final state of the device attainable upon the sequential play of available tokens of selected designations in selected paths to achieve the token and color end states.

In accordance with another embodiment of the present invention, there is disclosed a method of game play for an amusement device having a plurality of indicators each capable of displaying a plurality of different indicia and a plurality of tokens, the method comprising selecting one of the tokens for game play, arranging the indicia of the indicators in a predetermined pattern in response to the selecting of the token, rendering any number of the previously played tokens unavailable for game play and any number of the previously played tokens available for game play, continuing selecting one of the tokens available for game play until the indicators attain a predetermined indicia pattern and a predetermined number of the tokens become unavailable for game play.

BRIEF DESCRIPTION OF THE DRAWINGS

The above description, as well as further objects, features and advantages of the present invention will be more fully understood with reference to the following detailed description of an amusement device, when taken in conjunction with the accompanying drawings, wherein.

DETAILED DESCRIPTION

The amusement device of the present invention, as to be described more fully hereinafter, relates to a state of mind computer game employing an array of multi-colored lights and a plurality of logical balls or tokens which may be provided in multiple quantities and sizes or other designations as discussed hereinafter. By logical balls or tokens it is meant any means of creating or providing a player input into the amusement device, such as a binary or other like code, real balls or physical objects and the like, which enable continued game play by the user. The basic game strategy of the amusement device is to obtain what is referred to as a final state or solution.

In accordance with one embodiment of the present invention, the amusement device may be preprogrammed in which the final state will be achieved when (1) the array of lights display a predetermined pattern of colors, including a single color in rows, columns or both, and (2) trapping a predetermined number and kind of logical balls or tokens in what is referred to as being trapped within the amusement device, that is, being unavailable for subsequent play by the user.

Figure 1:
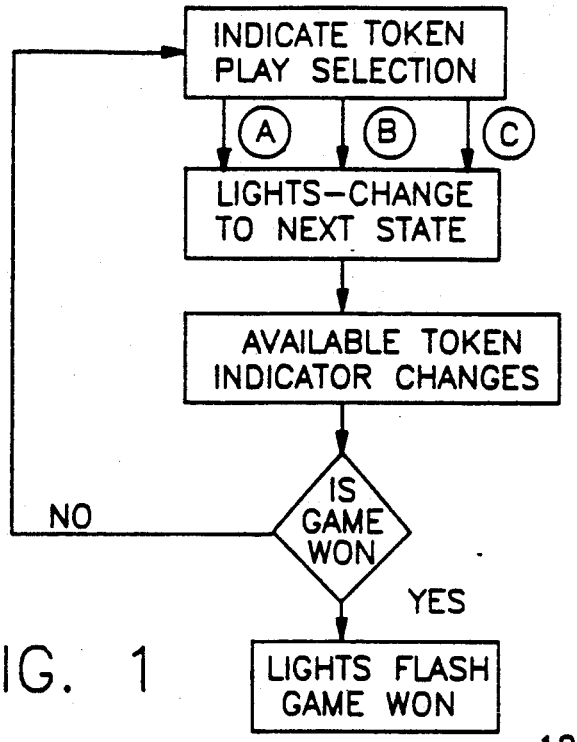
FIG. 1 is an overview of a software logic diagram illustrating the play of the amusement device from initiation to the final state or solution.

The logical balls or tokens, hereinafter referred to only as tokens, are used as game pieces to advance the game from the initial to final state. The specific example of the amusement device described employs six tokens, two large, two medium and two small. As shown in FIG. 1, the game is initiated by selecting a specific size token available for play and designating one of three available game paths, e.g. path A, path B or path C. Once the particular token path has been selected, the token will either be trapped by the amusement device, pass through the amusement device to be available for additional play or be trapped within the amusement device while causing a previously trapped token to be released for subsequent play. As the tokens are played, the individual lights of the matrix will change colors pursuant to a preprogrammed pattern as defined by an algorithm as to be described hereinafter. Depending upon the present state of the amusement device, e.g., the state of the matrix of colored lights and the state of the trapped tokens, the amusement device will advance to another state subsequent to the play of each token. The play of tokens continues causing a change in the state of the matrix of colored lights and available tokens for play. Upon achieving the final state of the amusement device, game play ends with a typical fanfare of a modern computer game such as by the flashing of the matrix of colored lights or the like.

Figure 2:
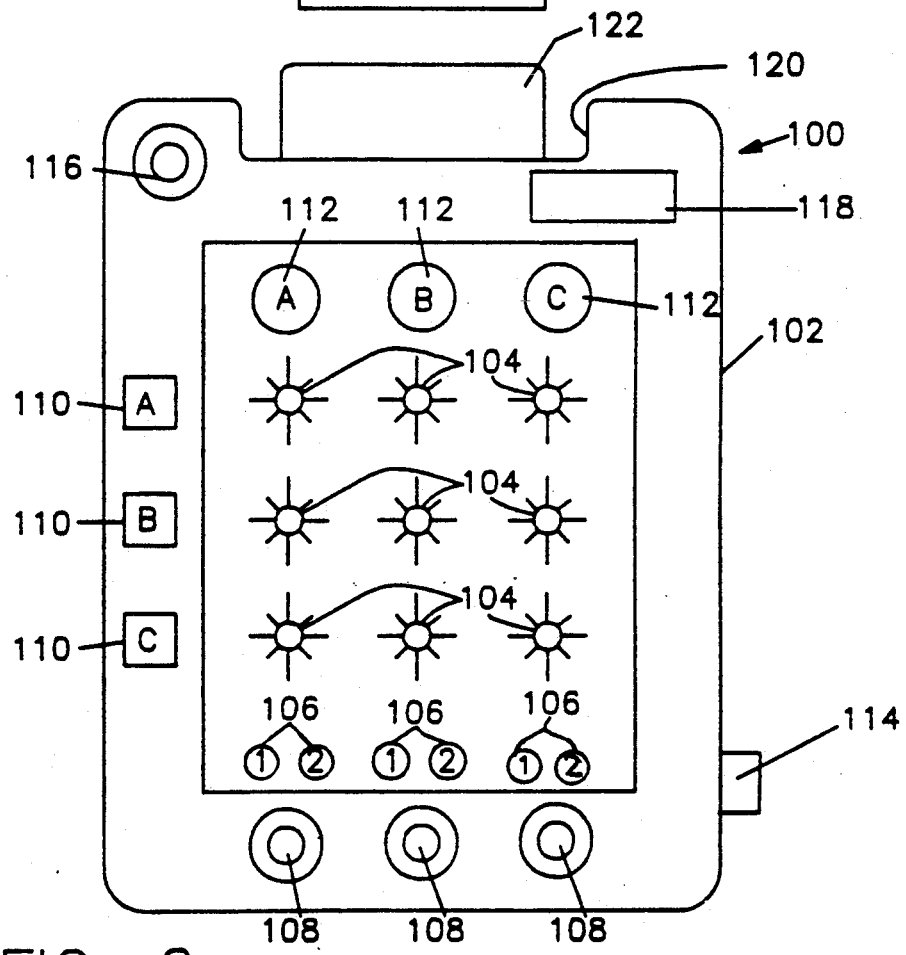
FIG. 2 is a diagrammatic illustration of an amusement device constructed in accordance with one embodiment of the present invention including a 3 x 3 array of multicolored light emitting diodes (LEDs) and employing logical balls or tokens for game play.

Referring once again to the drawings wherein like reference numerals represent like elements, there is disclosed in FIG. 2 an amusement device constructed in accordance with the present invention and generally designated by reference numeral 100. The device 100 includes a housing 102 to which there is centrally arranged a plurality of tristate LEDs 104 which are capable of displaying three different colors, e.g. green, red and orange, given the proper input code. The LEDs 104 may also display a greater or lesser number of color states. In addition, LEDs which display any single colors may be used which are grouped to provide selected patterns and arrays. The LEDs 104 are connected in series with resistors to limit the current which they encounter during operation of the amusement device 100. As shown, the LEDs 104 are arranged in a $3\times3$ matrix. However, it is to be understood that other matrixes for the LEDs 104 may be employed, for example, $4\times4$, $5\times5$, $6\times3$, $6\times5$, etc. As will be understood from a description of the amusement device 100, the particular size and arrangement of the matrix of LEDs 104 is arbitrary in nature and may be selected in accordance with the design parameters of the device and game to be played.

Conveniently positioned within the housing 102 are a plurality of available token indicators 106. The token indicators 106 are provided in the form of an LED which are selectively activated during game play to designate the number and size of tokens available for subsequent game play. A particular token is played using a corresponding available token selector button 108. The amusement device 100 as previously noted is played using six tokens of three different sizes, namely small, medium and large. The size of the tokens are noted by the different size of the token indicators 106. It is also contemplated that the tokens may be differentiated by other means such as designations of color, symbols or characters, for example, square, round, medium and triangular shape for the token indicators 106. The particular size token which is available for play is selected by one of the corresponding token selector buttons 108. Although only six tokens of three different sizes have been described, it is to be understood that a greater or lesser number may be used in accordance with the amusement device 100.

Each token is subsequently played through a particular path or input designated A, B or C by means of one of the path selector buttons 110. The particular path selected is displayed by one of the path indicators 112 which may each be provided as an LED.

The amusement device 100 further includes a game reset button 114, a game select button 116, a game display window 118 and an opening 120. The opening 120 is adapted to removably receive a plug in preprogrammed game cartridge 122 containing the necessary software for the particular game to be played. However, the amusement device 100 in its simplest form will be programmed for single game play as to be described.

Pursuant to the thus far described amusement device 100, the LEDs 104 are arranged in a $3\times3$ matrix, each LED having any one of four definable states. Each state of the LEDs 104 are differentiated by a particular color, with the off condition being considered a color and therefore one of the definable states. Game play progresses from state to state with each play of an available token. A state of the game is defined by the color of each LED 104 and the number and size of the tokens trapped by the amusement device, i.e., rendered unavailable for future game play. For purposes of describing the state of the game, the following conventions are used, the color off is represented by the number 0, while the other colors, for example, green, red and orange, are represented by the numbers 2 and 3 respectively. The amusement device 100 accordingly has four color states which includes the off color state.

The initial state of the amusement device 100, as well as when reset by reset button 114, can be represented by the state expression: State of Game=(0, 0, 0, 0, 0, 0, 0, 0, 0−0, 0, 0). The first nine zeros of this expression are representative of the color state of the nine LEDs 104. As expressed, the nine LEDs 104 in the matrix are displaying color represented by the number zero, i.e., the off state. The three zeros after the hyphen of the state of game expression represent the number of large, medium and small tokens rendered unavailable for game play. The initial state expression of the game indicates that there are no tokens trapped at the initial state of the amusement device 100.

In accordance with one game program for the amusement device 100, each vertical row of LEDs 104 are programmed to always display the same color during game play. By numbering the vertical columns of the matrix of LEDs 104 from left to right, the above expression representing the initial state of the game can be rewritten as: State of Game=(0, 0, 0,−0, 0, 0). Although the LEDs 104 have been arranged in a predetermined color pattern of vertical columns for the particular game play being described, it is to be understood that other color patterns may be employed. For example, the LEDs 104 may be arranged in a color pattern of horizontal rows, concentric squares, or any other color pattern desired, as well as being controlled individually independent of the other LEDs.

The next color state of the LEDs 104 during game play is derived from a light equation which is dependent upon token size played, token path selected and current state of the LEDs 104. This color function may be represented as follows:

Equation No. 1

$$L_{(f)}=T_{(s)}+T_{(p)}+L_{(s)}$$

where $T_{(s)}$=token size played $T_{(p)}$=token path selected $L_{(s)}$=current light state, i.e., color of LEDs The vertical columns of the LEDs 104 may be represented by the designations C1, C2 and C3 from left to right. The current color state of a particular LED 104 within the matrix may be represented by the designation Display (C1, C2 or C3). The specific color being displayed after playing a particular token in a designated path A, B or C uses the application of modular four mathematics as disclosed in Table I as to be described.

TABLE I

| MODULAR FOUR MATHEMATICS | | | |
|---|---|---|---|
| 0 + 0 = 0 | 1 + 0 = 1 | 2 + 0 = 2 | 3 + 0 = 3 |
| 0 + 1 = 1 | 1 + 1 = 2 | 2 + 1 = 3 | 3 + 1 = 0 |
| 0 + 2 = 2 | 1 + 2 = 3 | 2 + 2 = 0 | 3 + 2 = 1 |
| 0 + 3 = 3 | 1 + 3 = 0 | 2 + 3 = 1 | 3 + 3 = 2 |

The new color state of the LEDs 104 after playing a token is determined from the light equation using the color function as disclosed in Table II, in conjunction with the modular four mathematics as disclosed in Table I. The new color displayed by a column of LEDs 104 is a function of the addition of an additional number, i.e., a number selected from 0, 1, 2 or 3, which are arbitrarily chosen when programming the amusement device 100.

TABLE II

| | COLOR FUNCTION TABLE | | |
|---|---|---|---|
| | TOKEN PATH A | TOKEN PATH B | TOKEN PATH C |
| Small Token | C1 : Display(C1) + 0 | Display(C1) + 1 | Display(C1) + 3 |
| | C2 : Display(C2) + 3 | Display(C2) + 0 | Display(C2) + 1 |
| | C3 : Display(C3) + 1 | Display(C3) + 3 | Display(C3) + 0 |
| Medium Token | C1 : Display(C1) + 2 | Display(C1) + 0 | Display(C1) + 1 |
| | C2 : Display(C2) + 1 | Display(C2) + 2 | Display(C2) + 0 |
| | C3 : Display(C3) + 0 | Display(C3) + 1 | Display(C3) + 2 |
| Large Token | C1 : Display(C1) + 1 | Display(C1) + 0 | Display(C1) + 1 |
| | C2 : Display(C2) + 1 | Display(C2) + 1 | Display(C2) + 0 |
| | C3 : Display(C3) + 0 | Display(C3) + 1 | Display(C3) + 1 |

By way of example, a medium size token is played in Path B when the current state of the LEDs 104 in columns C1, C2 and C2 are off, red and orange, corresponding to 0, 2, 3. The new color state of column C1 will be determined using the modular four mathematics of Table 1 and the color function of Table II by the addition (0+0) which equals 0, resulting in column C1 displaying an off state. Similarly, column C2 will display a new color state based upon the addition (2+2) which equals 0, whereby column C2 will also display an off state. Finally, column C3 will display the color state based upon the addition (3+1) which equals 0, and hence, also displaying an off state. From the above described description employing modular four mathematics of Table I and the color function of Table II, the new color state of the LEDs 104 will be displayed after each play of a token through a designated path. Using the foregoing principals, it should be understood that different color states and different pattern arrangements of the LEDs 104 are attainable by altering the programmed color function or light equation as desired.

Since numbers are used to represent the colors of the LEDs 104, each number zero through three can be represented as a binary code employing two bits. Zero is represented by binary 00, one is represented by binary 01, two is represented by binary 10 and three is represented by binary 11. Using Tables I and II, a truth table for the next color state of the LEDs 104 during game play can be prepared. As an example, the truth table for the above example playing a medium token through Path B is disclosed in Table III.

TABLE III

| TRUTH TABLE FOR MEDIUM MARBLE PLAYED IN PATH B | | | |
|---|---|---|---|
| PRESENT | NEXT | PRESENT | NEXT |
| 000000 | 001001 | 100000 | 101001 |
| 000001 | 001010 | 100001 | 101010 |
| 000010 | 001011 | 100010 | 101011 |
| 000011 | 001000 | 100011 | 101000 |
| 000100 | 001101 | 100100 | 101101 |
| 000101 | 001110 | 100101 | 101110 |
| 000110 | 001111 | 100110 | 101111 |
| 000111 | 001100 | 100111 | 101100 |
| 001000 | 000001 | 101000 | 100001 |
| 001001 | 000010 | 101001 | 100010 |
| 001010 | 000011 | 101010 | 100011 |
| 001011 | 000000 | 101011 | 100000 |
| 001100 | 000101 | 101100 | 100101 |
| 001101 | 000110 | 101101 | 100110 |
| 001110 | 000111 | 101110 | 100111 |
| 001111 | 000100 | 101111 | 100100 |
| 010000 | 011001 | 110000 | 111001 |
| 010001 | 011010 | 110001 | 111010 |
| 010010 | 011011 | 110010 | 111011 |
| 010011 | 011000 | 110011 | 111000 |
| 010100 | 011101 | 110100 | 111101 |
| 010101 | 011110 | 110101 | 111110 |
| 010110 | 011111 | 110110 | 111111 |
| 010111 | 011100 | 110111 | 111100 |
| 011000 | 010001 | 111000 | 110001 |
| 011001 | 010010 | 111001 | 111010 |
| 011010 | 010011 | 111010 | 110011 |
| 011011 | 010000 | 111011 | 110000 |
| 011100 | 010101 | 111100 | 110101 |
| 011101 | 010110 | 111101 | 110110 |
| 011110 | 010111 | 111110 | 110111 |
| 011111 | 010100 | 111111 | 110100 |
| LIGHT EQUATION = 0 2 1 | | | |

The two most significant bits (MSB) represent the binary code established for the color displayed by the first column (C1) of LEDs 104, the next two bits establishing the color displayed by the second column (C2) of LEDs and the two least significant bits (LSB) establishing the color displayed by the third column (C3) of LEDs. Similar truth tables for each possible combination of token size and token path may be prepared.

An example of the application of the foregoing is set forth in Example I as follows:

EXAMPLE I

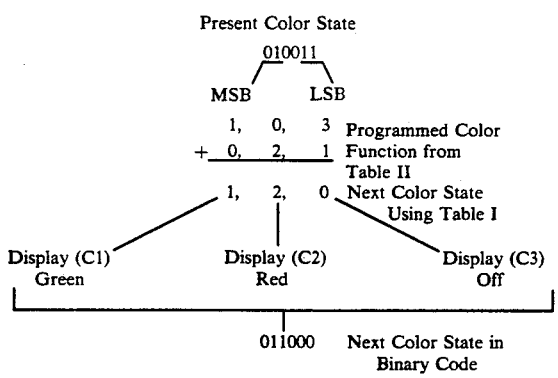

As previously described, the state of the amusement device 100 is based upon a number of independent and/or related variables. The first variable is the condition or state of the LEDs 104, i.e., displaying a particular color or colors. The state of the LEDs 104 are, from the light equation, a function of token size, token path and the current state of the LEDs 104. Attaining a particular state of the LEDs 104, however, has been selected to be independent of the tokens trapped during game play. The order of playing the tokens through any one of the selected paths also will not change the current state of the LEDs 104. The state of the LEDs, if desired can be programmed to be dependent upon token size, as well as solely upon the present state of the LEDs. It can be appreciated that the light equation defining the present state of the LEDs 104 can be arbitrarily chosen to include any number of variables presented by the amusement device 100.

The second variable of the amusement device 100 is both the size and number of different tokens trapped during game play. This variable, pursuant to one embodiment of the present invention, is dependent upon the sequence in which the tokens are played, while being independent of the present state of the LEDs 104.

The output condition for the state of the tokens trapped during game play is a function of token size being played and the number and size of tokens presently trapped. This function is expressed as follows:

Equation No. 2

$$T_{(f)}=T_{(s)}+T_{(t)}$$

where $T_{(s)}$=token size played $T_{(t)}$=number of tokens and size trapped

Figure 3:
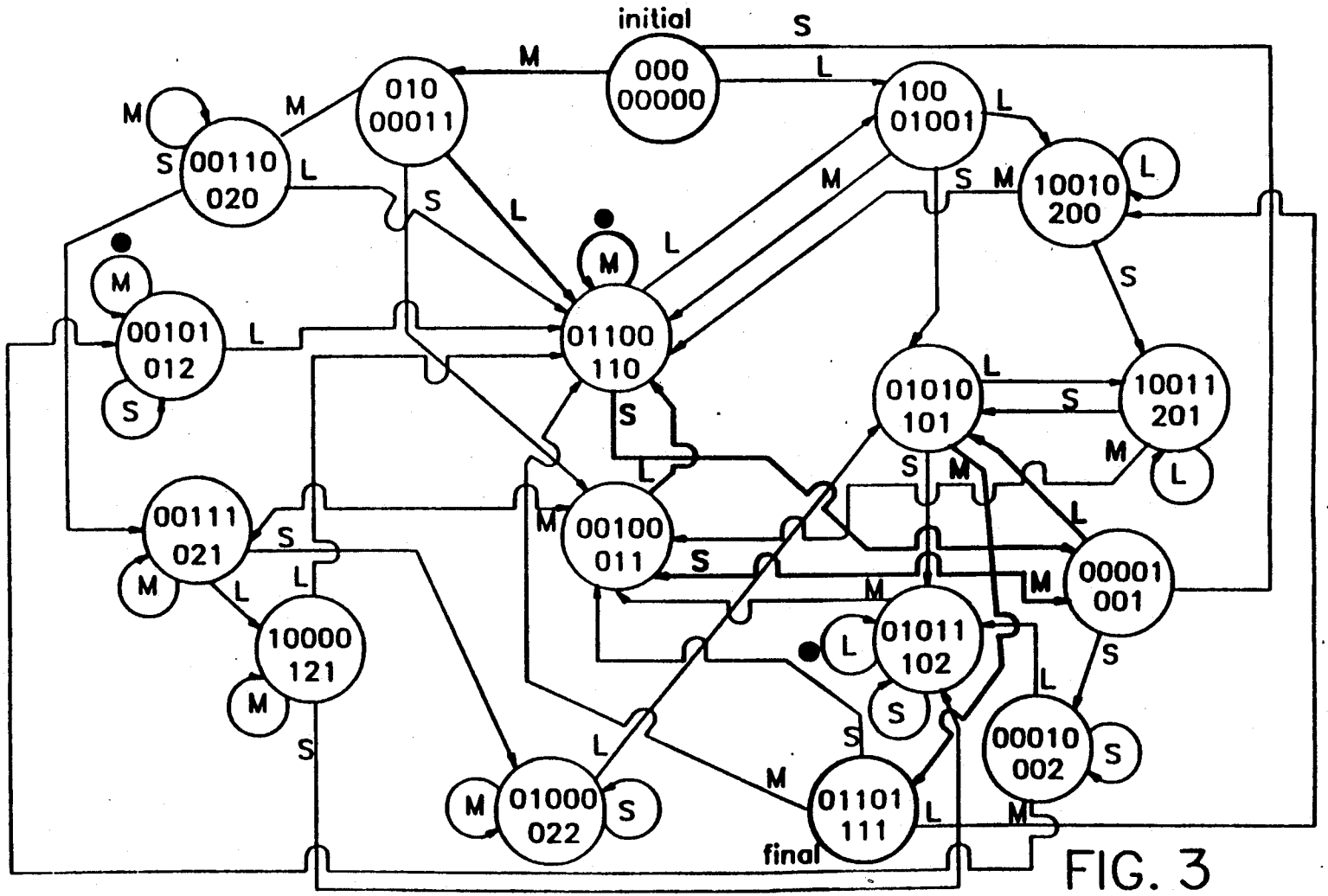
FIG. 3 is a state diagram for controlling game play of the amusement device with respect to the logical balls or tokens.

Referring to FIG. 3, there is disclosed a state diagram for the trapping function. The three digit decimal numbers inside the designated circles indicate which tokens (small, medium and large), are trapped during game play. The most significant digit corresponds to the number of large tokens trapped, the middle digit referring to the number of medium tokens trapped, and the least significant digit referring to the number of small tokens trapped. The lines beginning with a letter and ending with an arrowhead leads one to the next state for the trapped tokens for a particular size token being played. The lines that return back to the same state without a dot over the top, indicates that the transition does not exist. For example, when the player is at the state 0, 2, 0, one cannot enter a medium sized token because there are only two medium sized tokens used in the game, both already being trapped. In contrast, the lines that return to the same state with the dot over them, can and do exist for game play. The bold faced lines indicate the path representing a solution to the final state of the amusement device 100. As the trapping function is dependent on the order with which the tokens are played while independent of the token path, a solution is as follows:

1. Medium in Hole A
2. Large in Hole B
3. Small in Hole C
4. Medium in Hole A
5. Large in Hole C
6. Medium in Hole C
7. Small in Hole A
8. Large in Hole A
9. Medium in Hole B It is to be noted that this is only one solution and that other solutions may be possible.

The state diagram of FIG. 3 may be converted into binary codes to enable the preparation of a truth table. As previously noted, the three numbers within each circle are in decimal form. The group of five numbers within each circle are the binary representations of the tokens trapped during game play. Five bits are required because there are 17 different states in the state diagram shown. The truth table for trapping of tokens during game play is as follows:

TABLE IV

TRUTH TABLE FOR TRAPPING TOKENS

| PRESENT | INPUT | NEXT | OUTPUT | PRESENT | INPUT | NEXT | OUTPUT |
|---|---|---|---|---|---|---|---|
| 00000 | 000 | 00000 | 000000 | 01000 | 010 | — | — |
| 00000 | 001 | 00001 | 000000 | 01000 | 100 | 01010 | 001001 |
| 00000 | 010 | 00011 | 000000 | 01001 | 001 | 01010 | 000000 |
| 00000 | 100 | 01001 | 000000 | 01001 | 010 | 01100 | 000000 |
| 00001 | 001 | 00010 | 000000 | 01001 | 100 | 10010 | 000000 |
| 00001 | 010 | 00100 | 000000 | 01010 | 001 | 01011 | 000000 |
| 00001 | 100 | 01010 | 000000 | 01010 | 010 | 01101 | 000000 |
| 00010 | 001 | — | — | 01010 | 100 | 10011 | 000000 |
| 00010 | 010 | 00101 | 000000 | 01011 | 001 | — | — |
| 00010 | 100 | 01011 | 000000 | 01011 | 010 | 00100 | 010001 |
| 00011 | 001 | 00100 | 000000 | 01011 | 100 | 01011 | 010000 |
| 00011 | 010 | 00110 | 000000 | 01100 | 001 | 00001 | 010100 |
| 00011 | 100 | 01100 | 000000 | 01100 | 010 | 01100 | 000100 |
| 00100 | 001 | 00001 | 000101 | 01100 | 100 | 01001 | 010100 |
| 00100 | 010 | 00111 | 000000 | 01101 | 001 | 00100 | 010001 |
| 00100 | 100 | 01100 | 000001 | 01101 | 010 | 01100 | 000101 |
| 00101 | 001 | — | — | 01101 | 100 | 10010 | 000101 |
| 00101 | 010 | 00101 | 000100 | 10000 | 001 | 01011 | 001000 |
| 00101 | 100 | 01100 | 000010 | 10000 | 010 | — | — |
| 00110 | 001 | 00111 | 000000 | 10000 | 100 | 01100 | 010101 |
| 00110 | 010 | — | — | 10010 | 001 | 10011 | 000000 |
| 00110 | 100 | 01100 | 000100 | 10010 | 010 | 01100 | 010000 |
| 00111 | 001 | 01000 | 000000 | 10010 | 100 | — | — |
| 00111 | 010 | — | — | 10011 | 001 | 01010 | 010001 |
| 00111 | 100 | 10000 | 000000 | 10011 | 010 | 00100 | 100000 |
| 01000 | 001 | — | — | 10011 | 100 | — | — |

— is a non-existing condition

The truth table for the trapping function requires an eight bit input. The first five bits represent the number of tokens trapped, i.e., one of the seventeen designated states, during game play, the last three bits representing which size token was played. From the truth table, the output binary code is six bits wide. The total number of each size token available for game play has been selected as two tokens. If, for example, the amusement device 100 was instructed to release one large, two medium and no small tokens, the instructions in binary code would be 01, for the large tokens; 10, for the medium tokens; and 00 for the small tokens. This determines how the output code is manipulated for the trapping function. The current state 110 or 01100 located on the state diagram of FIG. 3 will output one large and one medium token if a large token is played. Referring to the truth table IV for the state 01100 with an input of 100, the output code is 010100; indicating the return of the desired tokens. The next state column in the truth table are completed by noting the states on the FIG. 3 state diagram with which the present state is advanced depending on what size token was played. In this particular example, the next state will be 01001 which represents one large and one small token being trapped.

Figure 4:
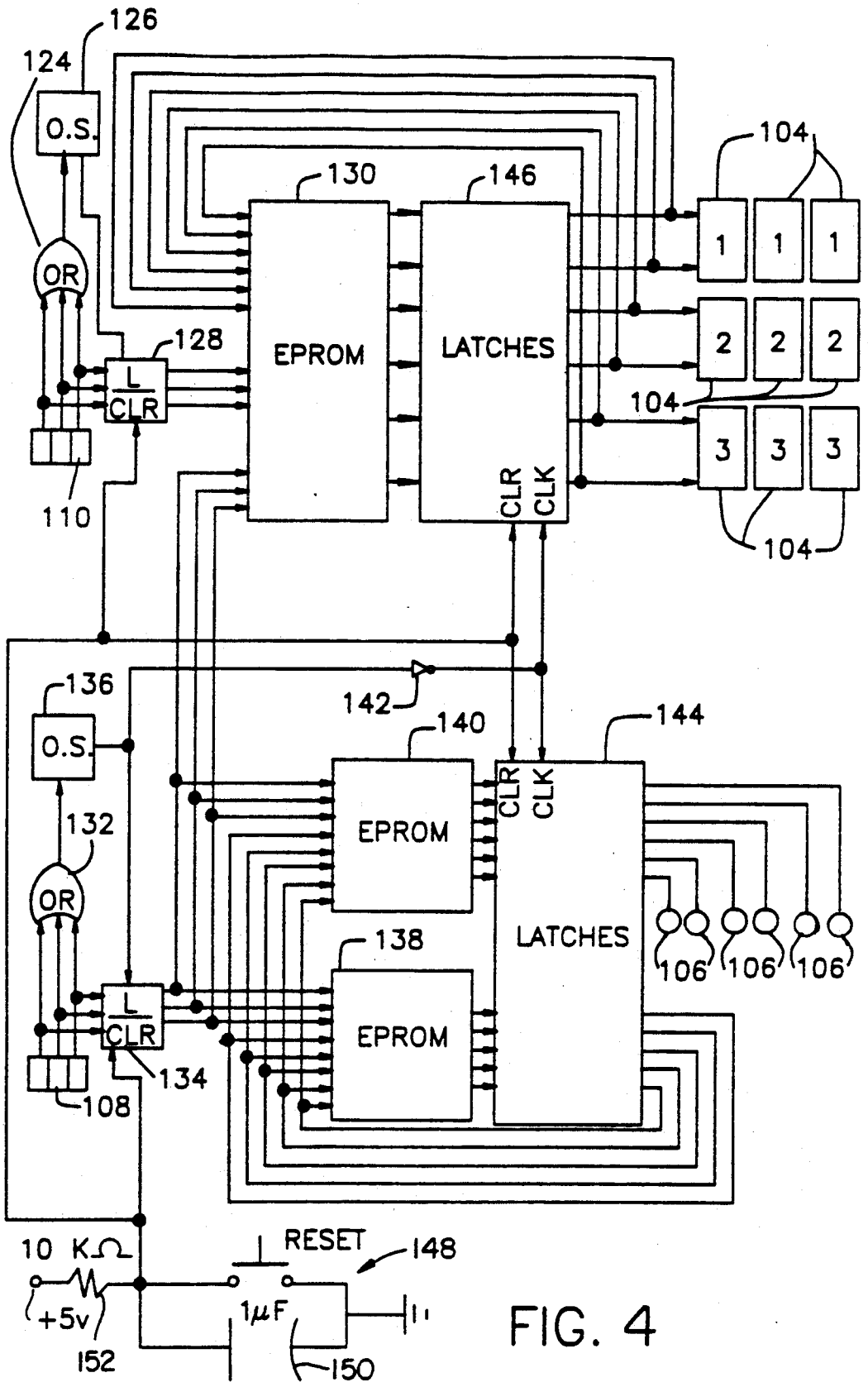
FIG. 4 is a functional block diagram of the circuit for the amusement device in accordance with one embodiment of the present invention.

The functional block diagram of the amusement device 100 is shown in FIG. 4. The upper half of the diagram illustrates how the LEDs 104 are connected, the lower half representing the connection for the trapping of the tokens during game play. The operation of the amusement device 100 will now be described with reference to FIG. 4.

Game play is initiated by selected a token path by engaging one of the path selector buttons 110 and selecting a particular size token to be played by means of one the token selector buttons 108. A three bit output code from the path selector button 110, representative of the particular token path selected, containing one high and two low bits is applied to an OR gate 124. The OR gate 124 will output a high as a result of a token being played to enable a one-shot monostable multivibrator 126 for 0.25 seconds. Simultaneously, the three bit output code from the path selector button 110 is applied to a latch 128 which is in the nature of a hex/-quadruple D-type flip-flop with a clear function. During this time interval, the output from the path selector button 110 will be latched by the one-shot's pulse which enables the latch 128. The purpose of the latching function is to preserve the three bit output code from the path selector button 110 to be provided as part of an input address for an erasable programmable read only memory 130 (EPROM). The EPROM 130 is preprogrammed to contain the next state conditions for the LEDs 104. After the 0.25 second interval is exhausted, the one-shot 126 will return to its normal state, i.e., low, and disable latch 128.

The determination of token size is achieved by the selection of a token selector button 108. Each token selector button 108 will produce a three bit output code using the same procedure as previously described with respect to the path selector buttons 110. The three bit code from the token selector button 108 is applied to an OR gate 132 and simultaneously to latch 134. The output from the token selector button 108 is latched by the output signal from a one-shot monostable multi-vibrator 136 in a similar manner as previously described with respect to latch 128. The three bit output code is simultaneously latched to a pair of EPROMs 138, 140. The one-shot 136 that enables the latching circuitry also enables, through inverter 142, latch 144 and latch 146.

EPROM 130 also receives the three bit output code from latch 134 corresponding to the token size. In addition, EPROM 130 receives a six bit binary output code from latch 146 corresponding to the current state of the LEDs 104. Accordingly, the EPROM 130 has been inputted with a three bit code corresponding to the size of the token, a three bit code corresponding to the token path selected and a six bit code corresponding to the present color state of the LEDs 104. These codes correspond to the variables in the light equation as set forth in Equation No. 1 hereinabove.

The EPROM 130 will output a six bit binary code representing the next color state of the LEDs 104 via latch 146. This is achieved by the inverter 142 which triggers the latch 146 on the negative transition of the pulse produced by the one-shot 136 which was fired by the three bit output code from one of the token selector buttons 108. After the output of the EPROM 130 has been latched, the LEDs 104 will display the next color state. The functional block diagram evidences that the next color state displayed by the LEDs 104 is dependent upon three variables, namely, token size played, token path selected and current color state as previously described.

To achieve the trapping function of the tokens, the two EPROMs 138, 140 are employed. Both of the EPROMs 138, 140 receive the three bit code corresponding to the token size and the five bit binary code corresponding to the current state of tokens trapped during game play. One of the EPROMs 138, 140 contains the next state data, while the other EPROM contains the output codes for determining which tokens are released during game play. When the correct data is presented on all the address lines to both EPROMs 138, 140, their output is latched. The time in which the data is latched is determined by the same negative transition on the pulse which was used to enable the latching circuitry for the EPROMs 130 output. This means the data presented on the output lines for all three EPROMs 130, 138, 140 in the circuit all latch at the same point in time. The six bit binary output code from the latch 144 is applied to the token indicators 106 to illuminate the state of tokens available for play and those trapped during the previous game play.

The amusement device 100 may be reset to its initial state by means of a reset switch 148. The reset switch 148 is arranged in parallel with capacitor 150 and in series with resistor 152. Once the reset switch 148 is pressed, the latches 128, 134, 144, 146 will output a high and reset the amusement device 100.

The EPROMs 130, 138, 140 are the heart of the amusement device 100 by containing the algorithms and binary code relating token play with both the state of the LEDs 104 and trapping function of the tokens. Once the game play routine and final state of the amusement device 100 has been determined and programmed vis-a-vis the EPROMs 130, 138, 140, the user may purchase other replacement circuit boards containing new EPROMs in the form of a game cartridge 122 as previously described. These new EPROMs will contain different instructions for the output devices, thereby creating different games to be played to a final state.

The amusement device 100 of the present invention can, as such, be used as a logical mind game marketed to a variety of age groups based on the difficulty of the specific game program. On one extreme, the amusement device may be programmed to provide a novelty challenge to MENSA members, while on the other hand, a memory game for children. In addition to a puzzle, the amusement device may be preprogrammed as a learning tool by accompanying each game program with a question book. Based upon a multiple choice answer, an action is taken. After answering all the questions, the amusement device 100 will indicate the results by using a light code when any answers are wrong and, for example, flashing the winning pattern if the answers are all correct. The amusement device 100 can also be preprogrammed as a mystery solving game. Since the state of the LEDs and trapping of the tokens follow a sequence, any maze or path finding game is playable. Similarly, it is envisioned that even a two player version can be devised where each player tries to prevent the other player from achieving their final state while trying to attain their own.

Figure 5:
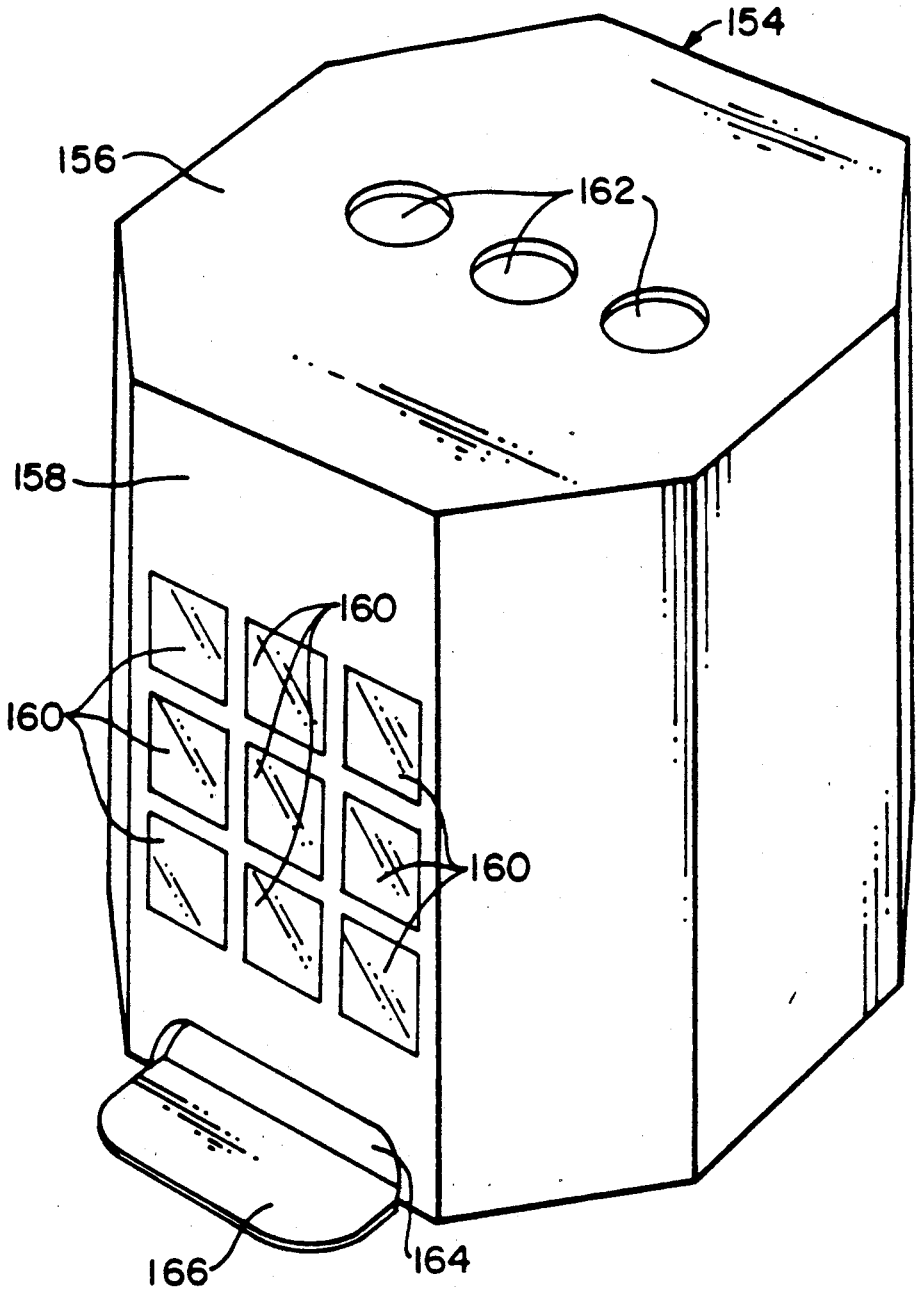
FIG. 5 is a schematic illustration of an amusement device constructed in accordance with another embodiment of the present invention.

The amusement device 100 has thus far been described by using logical balls or tokens for game play. It is contemplated that real balls or marbles may be used in a more mechanical version of the amusement device as shown in FIG. 5. The mechanical amusement device 154 includes a housing 156 supporting on its front face 158 a group of nine windows 160 arranged in a 3×3 matrix which are capable of illuminating one of four different colors at any one time as previously described. Three holes 162 are provided on the top of the housing 156, all of the same diameter, which enable any of the real balls or marbles to be entered into the housing 156. During game play, the real balls or marbles are selectively trapped within the housing 156 by mechanical means (not shown) pursuant to the operation and game play of the device. A return opening 164 for the marbles is provided which are received within tray 166.

The amusement device 154 is played by entering different size marbles into one of the three entry ports 162, one at a time, which constitutes a players turn. After the player enters a marble, both the entry port and the size of the marble played will be detected by suitable mechanical means (not shown) within the housing 156. With this information, the hardware inside the amusement device 154 will physically determine the next state of the device. For example, if the player is at the initial state, and enters a small marble into the middle entry port, the preprogrammed circuit within the housing 156 will cause the windows 160 to change in the preprogrammed format. It will be appreciated that game play of the amusement device 154 is as previously described with respect to the amusement device 100. The only difference between the two devices is the use of real balls or marbles as opposed to logical balls or tokens. The play will continue by entering marbles into the device through the access ports 162 until the final state is achieved. The final state pursuant to the previously described embodiment consists of all the windows 160 displaying the same color and the trapping mechanisms having one large, one medium and one small marble suppressed within the housing 156.

Although the invention herein has been described with references to particular embodiments, it is to be understood that the embodiments are merely illustrative of the principles and application of the present invention. For example, the LEDs 104 may be replaced with liquid crystal displays which display numbers or graphic patterns, including words or letters, which may be used instead of colors, for controlling game play to the final state or solution. It is therefore to be understood that numerous modifications may be made to the embodiments and that other arrangements may be devised without departing from the spirit and scope of the present invention as defined by the claims.

What is claimed is:

1. An amusement device including indicators and tokens having a final state, said device comprising a plurality of indicators each having a plurality of different indicator states, said indicator states arrangable into a selected predetermined pattern comprising an indicator end state, indicator in response to toke play control for controlling the state of said indicators, a plurality of tokens each having a first and second state, said tokens arrangable into selected ones of said first and second states comprising a token end state, and token control means for controlling the state of said tokens between said first and second states, said final state of said device comprising said tokens arranged in said token end state and said indicators arranged in said indicator end state.

2. The amusement device of claim 1, wherein said indicator control means comprises at least one memory device.

3. The amusement device of claim 1, wherein said tokens are of at least two different sizes or designations.

4. The amusement device of claim 1, wherein said token control means comprises at least one memory device.

5. The amusement device of claim 1, wherein said first state of said tokens comprising said tokens being available for game play and said second state comprising said tokens being unavailable for game play.

6. The amusement device of claim 1, wherein said indicator control means and said token control means are removable so as to be replaced with another indicator control means and token control means having a different final state form the indicator control means and the token control means being replaced thereby altering the play of said amusement device.

7. An amusement device including color indicators and tokens having a final state, said device comprising a plurality of color indicators each having a plurality of different color states, said color states arrangable into a predetermined pattern comprising a color end state, color indicator control means for controlling the color of said color indicators among said color states in response to token play, a plurality of tokens each having a first and second state, said tokens arrangable into selected ones of said first and second states comprising a token end state, and token control means for controlling the state of said tokens between said first and second states, said final state of said device comprising said tokens being in said token end state and the colors of said color indicators being in said color end state.

8. The amusement device of claim 7, wherein said color indicators comprise a plurality of multi-colored lights.

9. The amusement device of claim 7, wherein said color indicator control means comprises at least one memory device.

10. The amusement device of claim 7, wherein said tokens are of at least two different sizes or designations.

11. The amusement device of claim 7, wherein said token control means comprises at least one memory

12. The amusement device of claim 7, wherein said first state of said tokens comprising said tokens being available for game play and said second state comprising said tokens being unavailable for game play.

13. The amusement device of claim 7, wherein said indicator control means and said token control means are removable so as to be replaced with another indicator control means and said token control means having a different final state from the indicator control means and the token control means being replaced thereby altering the play of said amusement device.

14. An amusement device having a final state, said device comprising a plurality of lights each capable of displaying a plurality of different colors, the color of said lights arrangable into a plurality of color patterns in response to a light function, at least one of said color patterns comprising a color end state, light control means for controlling the color of said lights in response to said light function, a plurality of tokens of at least two different designations playable in a plurality of different paths, said tokens having a first and second state in response to a predetermined token function, said tokens being available for game play when in said first state and unavailable for game play when in said second state, said tokens arrangable into selected ones of said first and second states comprising a token end state, token control means for controlling the state of said tokens in response to said token function, said light function responsive to token play, said final state of said device attainable upon the sequential play of available tokens of selected designations in selected paths to achieve said token and color end states.

15. The amusement device of claim 14, wherein said color and token indicator control means each comprise at least one memory device.

16. The amusement device of claim 15, wherein said memory devices are removable so as to be replaced with memory devices having different light and token functions from those memory devices being replaced thereby altering the play of said amusement device.

17. The amusement device of claim 14, wherein color of said lights, the designation of said tokens and the token path.

18. The amusement device of claim 14, wherein said token control means is responsive to the designation of said token played and the number of tokens unavailable for game play and their respective designation.

19. A method of game play for an amusement device having a plurality of indicators each capable of displaying a plurality of different indicia and a plurality of tokens, said method comprising selecting one of said tokens for game play, arranging said indicia of said indicators in a predetermined pattern in response to said selecting of said token, designating any number of said previously played tokens unavailable for game play and any number of said previously played tokens available for game play, and continuing selecting one of said tokens available for game play until (i) said indicators attain a predetermined indicia pattern and (ii) a predetermined number of said tokens become unavailable for game play.

20. The method of claim 19, wherein said indicators comprise color indicators and said indicia comprises a plurality of colors.

21. The method of claim 20, further including playing the selected token in one of a plurality of different paths.

22. The method of claim 21, wherein said tokens are provided in a plurality of different sizes.

23. The method of claim 22, wherein said changing said colors of said color indicators in a predetermined color pattern is responsive to the token path and token size selected and the current colors of said color indicators.

24. The method of claim 22, wherein said designating any number of said previously played tokens unavailable for game play and any number of said previously played tokens available for game play is responsive to the token size selected for game play and the number and size of said tokens rendered unavailable for game play.

* * * * *

UNITED STATES PATENT AND TRADEMARK OFFICE

CERTIFICATE OF CORRECTION

PATENT NO. : 5,215,311

DATED : June 1, 1993

INVENTOR(S) : Michael P. Schuller

It is certified that error appears in the above-identified patent and that said Letters Patent is hereby corrected as shown below:

Column 5, line 5, after "numbers" insert --1,--.
Column 13, line 1, cancel "in response to toke play control for controlling the state of said indicators," and insert --control means for controlling the state of said indicators in response to token play,--.
Column 13, line 53, after "memory" insert --device.--.
Column 14, line 27, after "wherein" insert --said light control means is responsive to the current--.

Signed and Sealed this

Fifteenth Day of March, 1994

*Attest:*

Bruce Lehman

BRUCE LEHMAN

*Attesting Officer*

*Commissioner of Patents and Trademarks*